US006095071A

United States Patent [19]

Kozima et al.

[11] Patent Number: 6,095,071

[45] Date of Patent: Aug. 1, 2000

[54] FAULTY SEWING DETECTOR

[75] Inventors: Toshihiko Kozima, Toyonaka; Norio Nakata, Yoyonaka; Hiromichi Kurata, Yoyonaka; Takayoshi Masaoka, Yoyonaka, all of Japan

[73] Assignee: Yamato Sewing Machine Seizo Co., Ltd., Japan

[21] Appl. No.: 09/342,379

[22] Filed: Jun. 29, 1999

[30] Foreign Application Priority Data

Jun. 30, 1998 [JP] Japan ..... 10-220999

[51] Int. Cl.[7] ..... D05B 19/00

[52] U.S. Cl. ..... 112/470.01; 112/475.02

[58] Field of Search ..... 112/470.01, 272, 112/270, 277, 475.01, 475.02

[56] References Cited

U.S. PATENT DOCUMENTS 4,574,719 3/1986 Balke et al. ..... 112/272
4,869,187 9/1989 Little et al. ..... 112/270 X
4,924,790 5/1990 Kondo et al. ..... 112/272

*Primary Examiner*—Peter Nerbun
*Attorney, Agent, or Firm*—D. Peter Hochberg; William H. Holt

[57] ABSTRACT

Provided is a faulty sewing detector that is, for example, mounted on an overlock sewing machine, with which an over-edge chain stitch is made in a state in which a body fabric and a sleeve fabric of a T shirt or underwear are overlapped with each other. The detector comprises a fabric twisting detecting sensor that detects a fabric twisting by determining the number of overlap of fabrics sewed which is disposed at a position corresponding to the fabric sewing area of a needle, and, behind a needle location in a sewing direction; a faulty sewing judging means that compares a fabric twisting quantity detected by the sensor, with a preset permissible fabric twisting quantity, to judge it as faulty sewing when the former exceeds the latter; and an informing means that is activated when judged as faulty sewing. With this construction, a faulty sewing due to slip out even in performing a curve stitch can be detected reliably, and a variety of attachments, as required, can be mounted freely in front of the needle location.

6 Claims, 6 Drawing Sheets

FAULTY SEWING DETECTOR

BACKGROUND OF THE INVENTION

1. Field of the Invention

The present invention relates to a faulty sewing detector which, in performing an over-edge chain stitch that is made usually by an overlock sewing machine, detects a faulty sewing that one of two overlapping fabrics to be sewed deviates from an other, and informs it to the operator of this condition.

2. Description of the Prior Art

Faulty sewing that might occur in performing an over-edge chain stitch, etc. with an overlook sewing machine is generally classified as so-called slip out and twisting. specifically, as shown in FIG. 6, the slip out means that, of two overlapping fabrics sewed 1 and 2, the lower fabric 2 that is difficult to view by the operator deviates in its width direction X orthogonal to a sewing direction Y, with respect to the upper fabric 1, thereby a side end 2*a* of the lower fabric 2 departs from a seam 3. As shown in FIG. 7, the twisting means that sewing finish ends 1*b* and 2*b* of two fabrics 1 and 2, respectively, do not match with each other to cause twisting in a sewing direction Y. In the following description, twisting in direction X and that in Y direction are referred to as "slip out" and "twisting", respectively, and a state in which fabrics 1 and 2 are not matched, irrespective of X and Y directions, is referred to as "fabric twisting."

Referring to the faulty sewing called as twisting, as shown in FIG. 7, the sewing finish ends 1*b* and 2*b* can be easily held within a permissible twisting range making such a correction where the operator moves one of the fabrics 1 or 2. On the other hand, as to the faulty sewing called as slip out, as shown in FIG. 6, correction in the course of sewing is very difficult because twisting of the lower fabric 2 is difficult of view. In addition, the slip out is fatal to a sewing product and thus it is important to reliably remove it as defective article, at the sewing stage. This can be achieved by a faulty sewing detector.

As a faulty sewing detector of this type, there are known, for example, ones which are disclosed in Japanese Utility Model Examined Publication No. 59-25349 (1984) and Japanese Patent Unexamined Publication No. 3-91 (1991)

A device as described in the former publication detects a faulty sewing due to slip out by detecting the change in the transmitted light quantity which corresponds to the change in the number of overlap of fabrics sewed, with a sensor of the light transmission type which comprises a projector for projecting an inspection light beam to the fabrics, and a receptor for receiving the light beam passed through the fabrics.

A device as described in the latter publication comprises a first sensor for detecting the number of overlap of fabrics sewed, and a second sensor for detecting the presence of the fabric, which is spaced, with respect to the first sensor, a distance corresponding to a permissible slip out in the sewing direction. Thereby, a faulty sewing due to slip out or twisting is detected in a combination of the detecting actions of the first and second sensors.

The conventional faulty sewing detecting devices as described can perform the respective predetermined sewing fault detection. In these devices, however, each sensor is disposed at a position which corresponds to the fabric sewing area of a needle, and, in front of a needle location in the sewing direction. Thus, fabric twisting detected by such sensors is one which is already present prior to sewing, Namely, it is a forecast detection that, if sewing proceeds in this state, a sewing article may have a faulty sewing. With this forecast detection, when a fabric has no fabric twisting in front of a needle location, but has a fabric twisting until it reaches the needle location, a faulty sewing due to the fabric twisting cannot be detected. In performing a curve stitch which is, in particular, liable to involve slip out when a fabric sewed is fed from a position in front of a needle location to the needle location, it is impossible to detect a faulty sewing due to the slip out.

More specifically, when a fabric sewed is, for example, a T shirt or underwear as shown in FIG. 8 or 9, a body fabric 1 and a sleeve fabric 2 are fed to a needle location in a state in which an in-curve 1*c* of the body fabric 1 and an out-curve 2*c* of the sleeve fabric 2 are overlapped and matched with each other, as shown by the dotted line in FIG. 9. Then, sewing proceeds such that a seam 3 is formed along a curve part in which the in-curve 1*c* conforms to the out-curve 2*c*. In this case, the operator overlaps the in-curve 1*c* of the body fabric 1 and the out-curve 2*c* of the sleeve fabric 2 as perfect as possible, and feeds them in front of the needle location. However, since the part to be sewed is a curve, the in-curve 1*c* and the out-curve 2*c* are often not matched at the time when they reach the needle location by the succeeding feed operation. Thus, the conventional faulty sewing detecting device cannot detect the faulty sewing due to the slip out as described. Hence it is required to examine the article after the sewing therefor is terminated.

Further, in the conventional faulty sewing detecting device, since each sensor is disposed in front of the needle location, it is difficult to allow space in front of the needle location, available for various attachments to assist sewing operation. Alternatively, the function of detecting a predetermined faulty sewing is liable to be impaired by installation of attachments.

SUMMARY OF THE INVENTION

Accordingly, it is a primary object of the present invention to provide a faulty sewing detector with which a faulty sewing due to slip out can be reliably detected even in performing a curve stitch, and a variety of attachments can be mounted freely, as required, in front of a needle location, without impairing the function of detecting faulty sewing.

It is another object of the invention to simplify the whole construction including a signal processing circuit, realize the same at low cost, and reduce the space therefor.

It is still another object of the invention to allow a faulty sewing detection to be applied effectively and suitably to a variety of fabrics sewed, To achieve the primary object, a faulty sewing detector according to a first aspect comprises: a fabric twisting detecting sensor which detects the presence of a fabric twisting by detecting the number of overlap of fabrics sewed, and is disposed at a position corresponding to the fabric sewing area of a needle, and, behind a needle location in a sewing direction: a faulty sewing judging means that compares a preset permissible fabric twisting quantity and a fabric twisting quantity in its lengthwise direction along the sewing direction which is detected by the sensor, to judge it as faulty sewing when the detected fabric twisting quantity exceeds the preset permissible quantity; and an informing means that is activated upon receipt of an output signal from the judging means.

In the construction of the first aspect, the fabric twisting detecting sensor is located behind the needle location in the sewing direction, such as to detect and inform of a faulty sewing due to fabric twisting covering an article passed through the needle location. This ensures to detect and inform of a faulty sewing due to fabric twisting that does not exist in front of the needle location but exists after passing therethrough, and thus avoids shipment of a defective article, without visual inspection of the completed article. In addition, the fabric twisting detecting sensor disposed behind the needle location in the sewing direction enables to allow space in front of the needle location. Thereby, a variety of attachments can be mounted freely, as required, without impairing the function of faulty sewing detection.

According to a second aspect, the faulty sewing detector of the first aspect is characterized in that the fabric twisting detecting sensor is solely provided behind the needle location in the sewing direction. With this construction, a faulty sewing due to slip out, which is fatal to sewing articles, can be detected reliably. Furthermore, the whole construction including a signal processing circuit, can be simplified and realized at low cost, and the space therefore can be reduced, as compared with one of the conventional devices in which the two sensors are disposed apart a distance corresponding to a permissible twisting quantity in the sewing direction, According to a third aspect, the faulty sewing detector of the first aspect is characterized in that the permissible twisting quantity is changeable by varying the time limit of a timer which is activated by the number of stitches, alternatively, at the time when the sensor detects a fabric twisting. With this construction, a permissible twisting quantity which enables to detect a fabric twisting that might occur locally due to cutting error, etc. in the course of sewing, can be changed arbitrarily with ease. This permits a useful and suitable application to faulty sewing detection covering a variety of fabrics to be sewed.

According to a fourth aspect, the faulty sewing detector of the first aspect is characterized in that the fabric twisting detecting sensor is a sensor of the light transmission type which comprises a projector for projecting a pulse-like light beam to a fabric to be sewed when feed dogs of a sewing machine are in a non-action state, and a receptor for receiving the light beam passed through the fabric. With this construction, it is possible to detect a fabric twisting in a stable state in which a fabric to be sewed is not subjected to the feed action by feed dogs, thereby avoiding false detection and false information.

These and other objects, features, aspects and advantages of the present invention will become more apparent from the following detailed description of the present invention when taken in conjunction with the accompanying drawings.

DESCRIPTION OF THE PREFERRED EMBODIMENTS

One preferred embodiment of the present invention will be described by referring to the accompanying figures.

Figure 1:
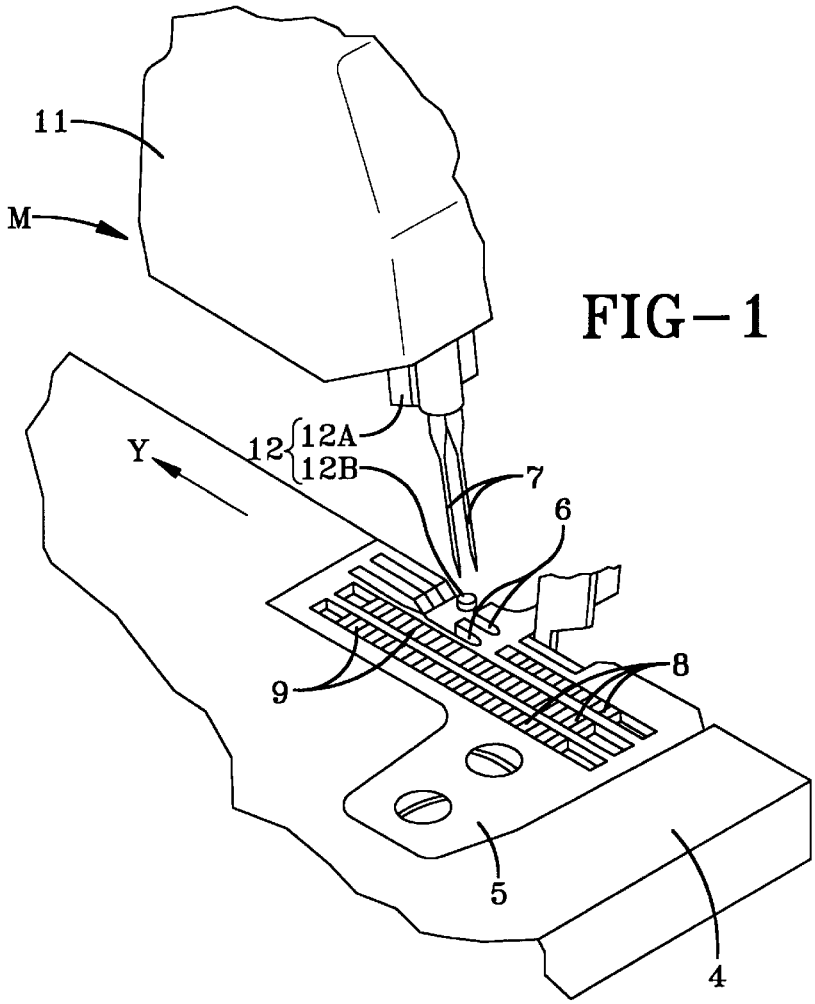
FIG. 1 is a perspective view of the main parts of an overlock sewing machine equipped with a faulty sewing detector according to the present invention.
Figure 2:
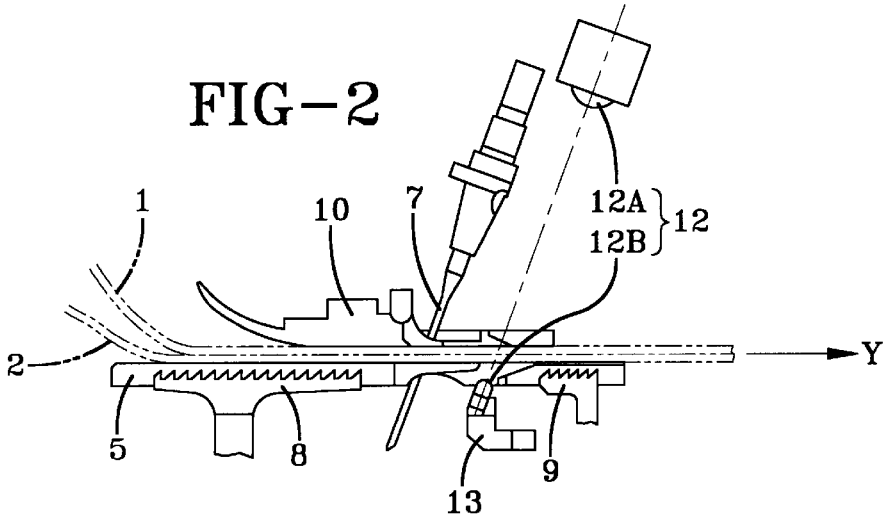
FIG. 2 is a right side view of the main parts of the above sewing machine.
Figure 6:
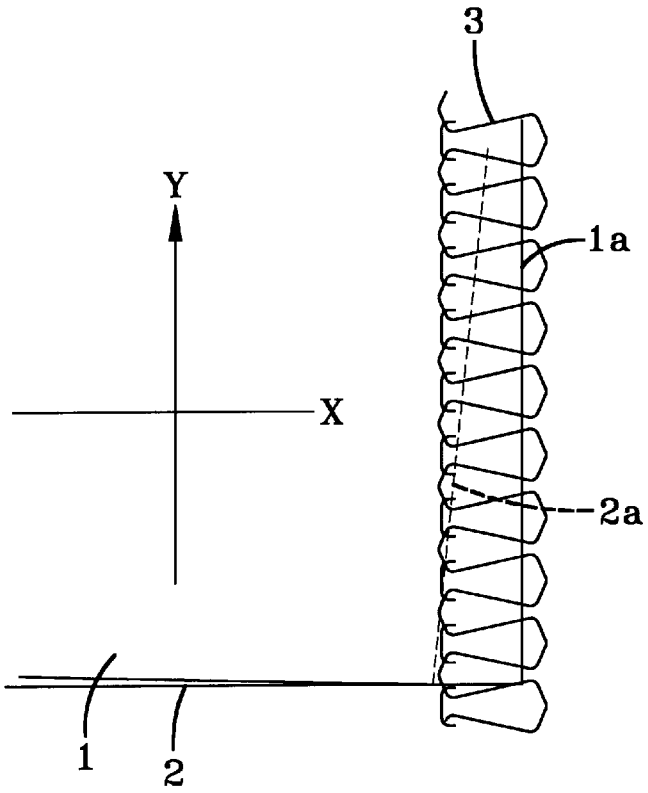
FIG-6 PRIOR ART
FIG. 6 is a plan view of the main parts illustrating a slip out as an example of faulty sewing in prior art.

FIG. 1 is a perspective view of the main parts of an overlock sewing machine M equipped with a faulty sewing detector according to the present invention. FIG. 2 is a right side view of the main parts of the above sewing machine. A throat plate 5 is secured to a cloth plate 4 of the sewing machine M such that the cloth plate 4 is even with the surface of the throat plate 5. Front feed dogs 8 and rear feed dogs 9 are located beneath the throat plate 5 in front of and behind a needle location 6 of a needle 7 which is supported such as to be movable vertically reciprocally to a sewing machine head 11. The front and rear feed dogs 8 and 9 feed two fabrics sewed 1 and 2 that are overlapped vertically with each other, in a sewing direction indicated by the arrow Y. Disposed above the throat plate 5 is a presser foot 10 with which the fabrics 1 and 2 are pressed into contact with the surface of the throat plate 5. While the front and rear feed dogs 8 and 9 feed the fabrics 1 and 2 successively along the surface of the throat plate 5 in the sewing direction Y, an over-edge chain stitch is performed, as shown in FIG. 6, to form a wide seam 3 in a fabric width direction X orthogonal to the sewing direction Y, in cooperation of the needle 7 and a magnifier (not shown). Here, part corresponding to the width of a seam 3 becomes a fabric sewing area.

A fabric twisting detecting sensor 12 of the light transmission type is provided behind the needle location 6 on the throat plate 5 in the sewing direction Y. The sensor 12 comprises a projector 12A which projects a transmitted light beam to the fabrics 1 and 2, and is secured above the throat plate 5, and a receptor 12B for receiving the light beam passed through the fabrics 1 and 2, which is secured at a position corresponding to the projector 12, via a fitting member 13.

The fabric twisting detecting sensor 12 detects a fabric twisting by determining whether the number of overlap of the fabrics 1 and 2 is one or two in number, based on the change in the quantity of light received by the receptor 12B. The projector 12A is designed to project (irradiate) light beam in a state of pulse to the fabrics 1 and 2, when the front and rear feed dogs 8 and 9 are in a non-feed state and the presser foot 10 is in a fabric pressing state.

Figure 3:
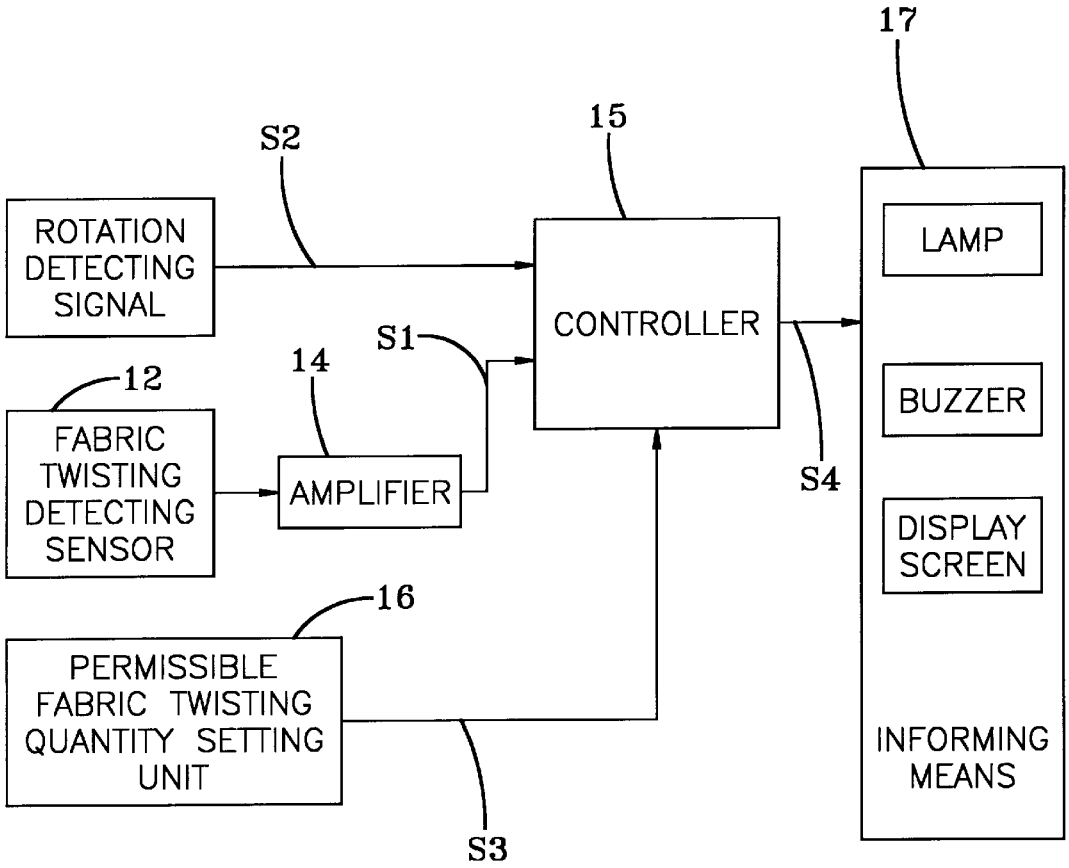
FIG. 3 is a block diagram illustrating a circuit construction of a faulty sewing detector including a fabric twisting detecting sensor.

FIG. 3 is a block diagram illustrating a circuit construction of a faulty sewing detector including a fabric twisting detecting sensor 12. A detecting signal S1 from the detecting sensor 12 is amplified in an amplifier 14 and then inputted to a controller 15. In addition to the detecting signal S1, a rotation detecting signal S2 and a permissible twisting quantity (the number of stitches) setting signal S3 are inputted to the controller 15. The rotation detecting signal S2 is provided from a rotation detector which is, for example, mounted on the main shaft (not shown) of the sewing machine M, for detecting the presence of rotation. The permissible twisting quantity setting signal S3 is provided from a permissible fabric twisting quantity setting unit 16, through which the operator previously inputs, in numeric value, the number of stitches as a lengthwise permissible twisting quantity along the sewing direction Y. The controller 15 compares the number of stitches that corresponds to the input duration of the fabric twisting detecting signal S1, with the permissible number of stitches given by the setting signal 3. When the former exceeds the latter, the controller 15 outputs signal S4.

A faulty sewing informing means 17 comprising at least one of the group consisting of a lamp, buzzer and display screen, is connected to the controller 15. Upon receipt of an output signal S4 from the controller 15, the informing means 17 lights up the lamp, sounds the buzzer, or activates the display screen, thereby informing the operator of the occurrence of a faulty sewing. The permissible twisting quantity can be changed arbitrarily by varying the number of stitches. Instead of the number of stitches, a timer which is activated at the time when the detecting signal S1 from the fabric twisting detecting sensor 12 is inputted to the controller 15, may be used such that the permissible twisting quantity is changed by varying the time limit of the timer.

Figure 4:
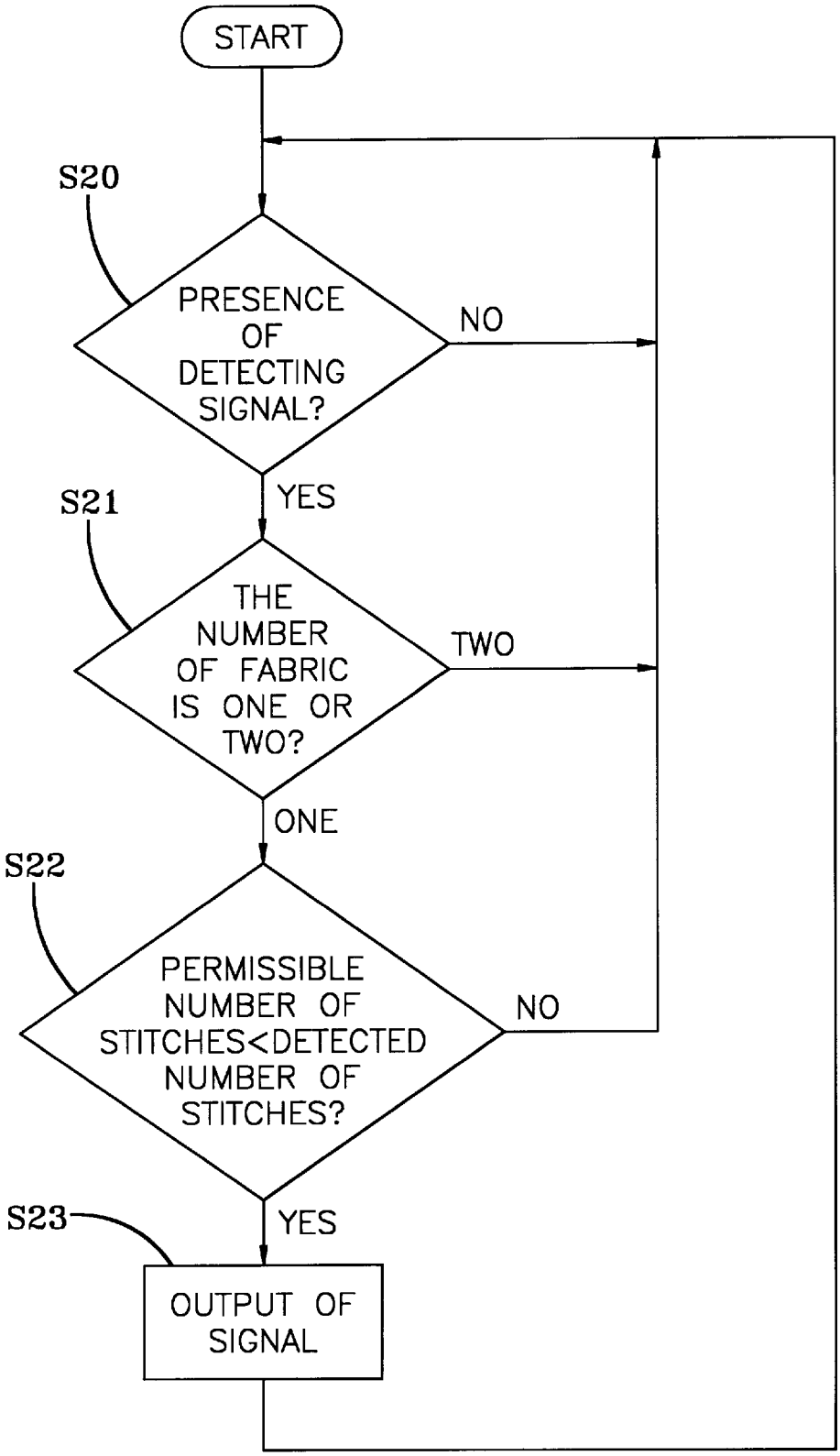
FIG. 4 is a flow chart illustrating operation of a faulty sewing detection in sewing a sleeve.
Figure 8:
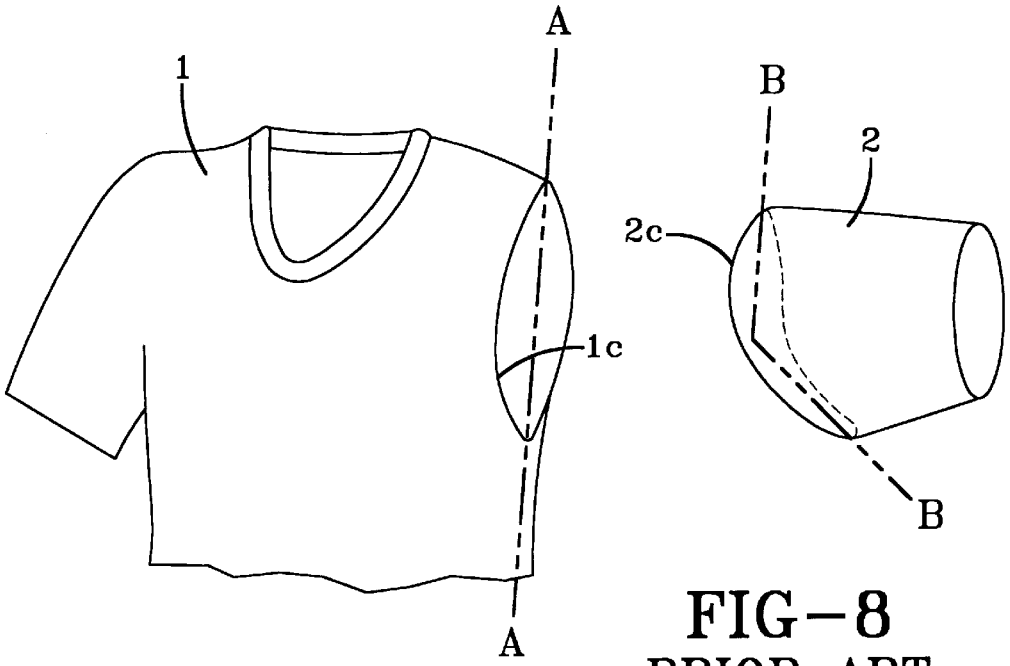
FIG-8 PRIOR ART
FIG. 8 is a perspective view of the appearance of an article to be sewed in prior art.
Figure 9:
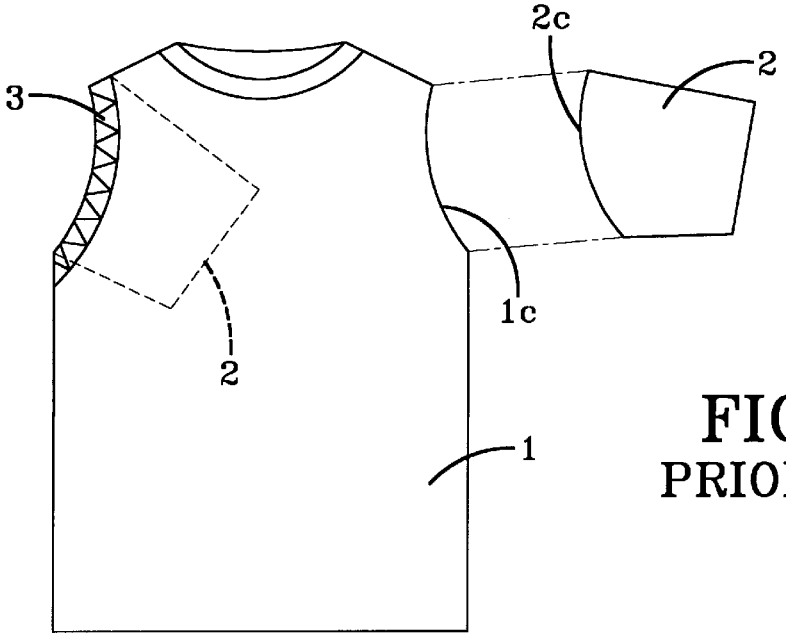
FIG-9 PRIOR ART
FIG. 9 is a front view illustrating the sewing conditions of an article to be sewed in prior art.

Referring to the flow chart of FIG. 4, a brief description will be made of the operation of a faulty sewing detection when sewing the sleeve of a T shirt as shown in FIG. 8 or 9, by using an overlook sewing machine M equipped with a faulty sewing detector of the construction as described.

Figure 5:
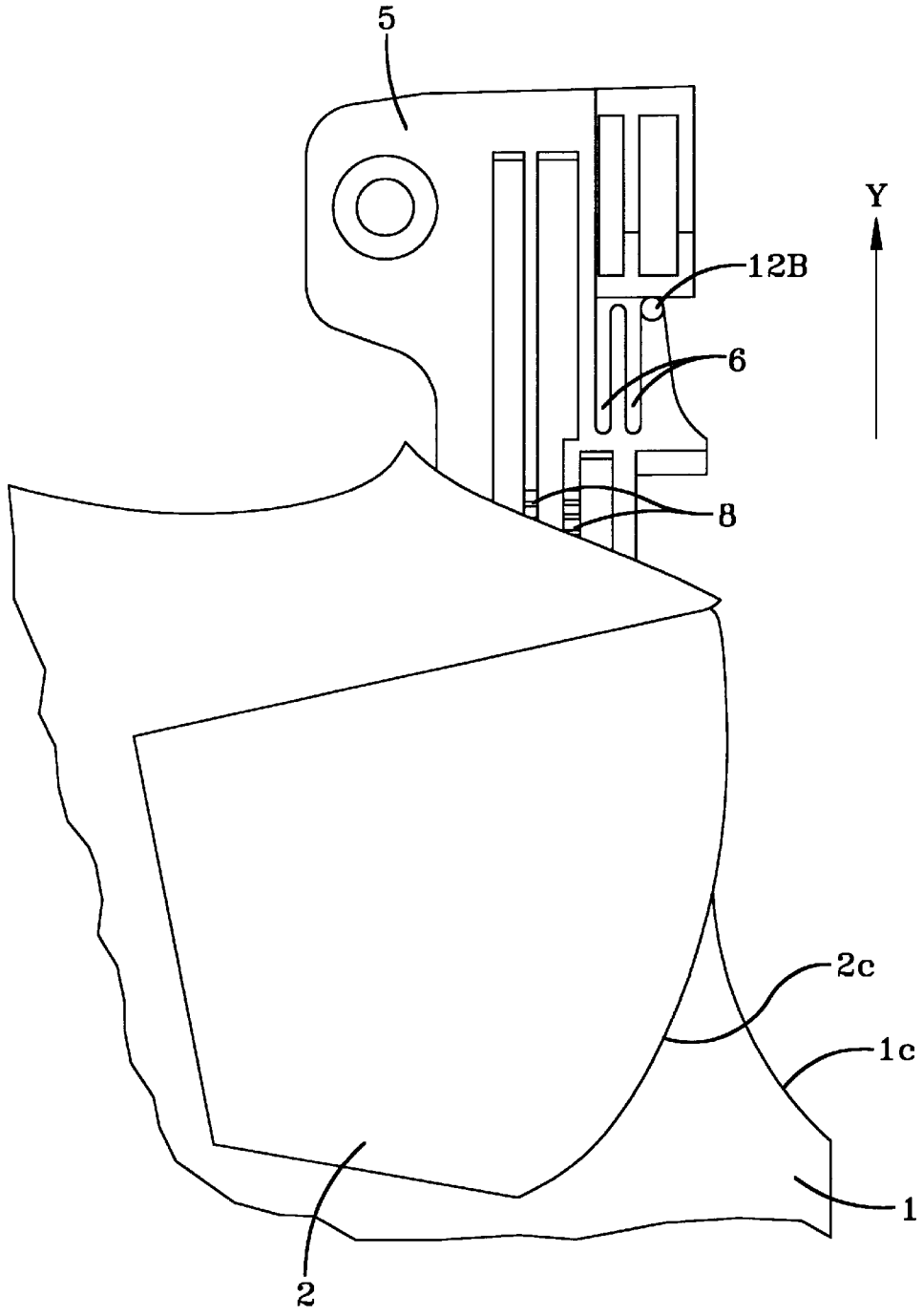
FIG. 5 is an enlarged plan view illustrating a state in which a sleeve is being sewed, a fabric sewed corresponding to that in cross-section taken along the line A—A and line B—B in FIG. 8.

An out-curve 2*c* of a sleeve fabric 2 and an in-curve 1*c* of a body fabric 1 of a T shirt or the like are overlapped such as to match with each other, as shown in FIG. 5, and they are fed successively by front and rear feed dogs 8 and 9 along the surface of a throat plate 5 in a sewing direction Y. At the same time, a sleeve sewing with over-edge chain stitch is performed such as to form a wide seam 3 along the curve part in a fabric width direction X orthogonal to the sewing direction Y, in cooperation of a needle 7 and a magnifier (not shown), During this sleeve sewing with over-edge chain stitch, a pulse-like light beam is projected from a projector 12A of a fabric twisting detecting sensor 12 to fabrics sewed 1 and 2 after passed through a needle location 6, and the light beam is then received by a receptor 12S. Based on the change in the quantity of light received by the receptor 12B, it is determined whether the number of overlap of the fabrics 1 and 2 after sewing is one or two in number, to detect a fabric twisting (steps S20, S21). In the absence of fabric twisting, namely, when the number of overlap is two in number, the sleeve sewing proceeds without moving to the next step. In the presence of fabric twisting, namely, when the number of overlap is one in number, a fabric twisting detecting signal S1 is inputted to a controller 15.

A stitch number setting signal S3 as a lengthwise permissible twisting quantity along the sewing direction Y, is already inputted to the controller 15, which signal is previously inputted in numeric value to a permissible fabric twisting quantity setting unit 16 by the operator. The number of stitches given by the setting signal S3 is compared with the detected number of stitches given by the fabric twisting detecting signal S1 (step S22). When the detected number of stitches is smaller than the permissible number of stitches, signal S4 is not outputted. When the former exceeds the latter, it is judged that the twisting quantity of the fabrics 1 and 2 exceeds the permissible twisting quantity and thus leads to a faulty sewing due to slip out. Upon this, signal S4 is outputted from the controller 15 (step S23). When the signal S4 from the controller 15 is inputted to a faulty sewing informing means 17, a lamp lights up, or a buzzer sounds, thereby the operator is informed of the occurrence of a faulty sewing That is, the operator is aware that the article after its sleeve sewing is defective.

As described above, thanks to the arrangement that the fabric twisting detecting sensor 12 is disposed behind the needle location 6 in the sewing direction Y, it is possible to reliably detect and inform of a faulty sewing caused in the event that a fabric twisting does not occur in front of the needle location 6, but a faulty sewing due to fabric twisting is recognized after the actual sewing. This avoids shipment of defective articles, without visual inspection of the final product.

In addition, the fabric twisting detecting sensor 12 disposed behind the needle location 6 in the sewing direction Y, permits to secure sufficient space for mounting a variety of attachments in front of the needle location 6.

The fabric twisting detecting sensor 12 can be any sensor which can detect the number of overlap of fabrics sewed 1 and 2. As described in the foregoing preferred embodiment, by arranging such that a pulse-like light beam is projected to the fabrics 1 and 2 from a projector 12A of a fabric twisting detecting sensor 12 of the light transmission type when the front and rear feed dogs 8 and 9 are in a non-feed state, it is possible to detect a fabric twisting in a state in which the fabrics sewed 1 and 2 are not subjected to the feed action by the feed dogs 8 and 9, so that both fabrics are held in a stable state on a throat plate 4, by a presser foot 10. This prevents false fabric twisting detection and false information.

Further, the arrangement that in mounting a fabric twisting detecting sensor 12 of the light transmission type, a receptor 12B is disposed beneath a throat plate 5 as described in the foregoing preferred embodiment, permits that the receptor 12B is automatically cleaned when a fabric sewed passes therethrough. This suppresses the sensitivity of the receptor 12B from being deteriorated with time.

Figure 7:
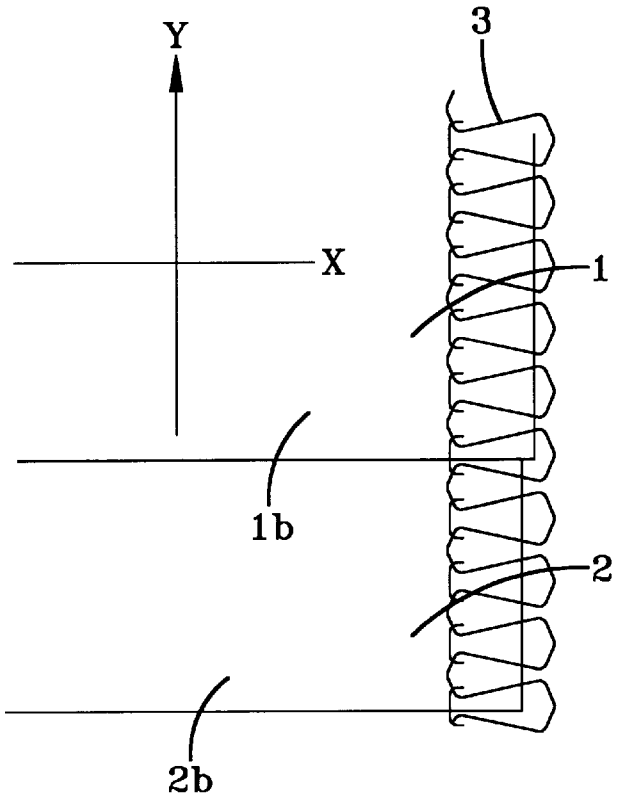
FIG-7 PRIOR ART
FIG. 7 is a plan view of the main parts illustrating a twisting as an example of faulty sewing in prior art.

Although a predetermined faulty sewing detection is effected only by a single fabric twisting detecting sensor 12 of the light transmission type which is to be located behind a needle location 6 in the sewing direction Y, a sensor for detecting a slip out, as shown in FIG. 7, may be disposed in front of the needle location 6.

It is desirable that the position of the fabric twisting detecting sensor 12 is adjustable in direction X orthogonal to the sewing direction Y, so as to correspond to the width of an over-edge chain stitch to a fabric sewed.

Additionally, since the present invention aims to avoid shipment of defective articles by allowing the operator to recognize the occurrence of faulty sewing, the informing means 17, such as a lamp, buzzer and display screen, is provided. In addition to this, there may be added such a structure that the operation of a sewing machine M is automatically stopped upon detection of a faulty sewing.

While the invention has been shown and described in detail, the foregoing description is in all aspects illustrative and not restrictive It is therefore understood that numerous modifications and variations can be devised without departing from the scope of the invention.

What is claimed is:

1. A faulty sewing detector for detecting faulty sewing of a fabric having a number of fabric layers which are sewed with a number of stitches within a time limit, said faulty sewing detector comprising:

a fabric twisting detecting sensor that detects a fabric twisting by determining a number of fabric layers to be sewed which overlap, said sensor being disposed at a position corresponding to the fabric sewing area of a needle, and, behind a needle location in a sewing direction;

a faulty sewing judging means that compares a preset permissible fabric twisting quantity and a fabric twisting quantity as measured in a lengthwise direction along said sewing direction, which is detected by said sensor, to judge faulty sewing when the detected fabric twisting quantity exceeds said preset permissible fabric twisting quantity said permissible fabric twisting quantity being changeable by varying the time limit of a timer which is activated by the number of stitches, alternatively, at the time when said fabric twisting detecting sensor detects a fabric twisting; and an informing means that is activated upon receipt of an output signal from said judging means.

2. A faulty sewing detector according to claim 1 wherein said fabric twisting detecting sensor is solely provided behind said needle location in said sewing direction.

3. A faulty sewing detector comprises:

a fabric twisting detecting sensor that detects a fabric twisting by determining a number of fabric layers to be sewed which overlap, said sensor being disposed at a position corresponding to the fabric sewing area of a needle, and, behind a needle location in a sewing direction said fabric twisting detecting sensor is a sensor of the light transmission type which comprises a projector for projecting a pulse-like light beam to a fabric sewed when feed dogs of a sewing machine are in a non-action state, and a receptor for receiving the light beam passed through the fabric, disposed such as to correspond to said projector;

a faulty sewing judging means that compares a preset permissible fabric twisting quantity and a fabric twisting quantity as measured in a lengthwise direction along said sewing direction, which is detected by said sensor, to Judge faulty sewing when the detected fabric twisting quantity exceeds said preset permissible fabric twisting quantity; and an informing means that is activated upon receipt of an output signal from said judging means.

4. A faulty sewing detector according to claim 3 wherein said fabric twisting detecting sensor is solely provided behind said needle location in said sewing direction.

5. A faulty sewing detector comprises:

a fabric twisting detecting sensor that detects a fabric twisting by determining a number of fabric layers to be sewed which overlap, said sensor being disposed at a position corresponding to the fabric sewing area of a needle, and, behind a needle location in a sewing direction, the position of said fabric detecting sensor being adjustable in a direction orthogonal to said sewing direction;

a faulty sewing judging means that compares a preset permissible fabric twisting quantity and a fabric twisting quantity as measured in a lengthwise direction along said sewing direction, which is detected by said sensor, to judge faulty sewing when the detected fabric twisting quantity exceeds said preset permissible fabric twisting quantity; and an informing means that is activated upon receipt of an output signal from said judging means.

6. A faulty sewing detector according to claim 5 wherein said fabric twisting detecting sensor is solely provided behind said needle location in said sewing direction.

* * * * *